United States Patent [19]

Marciniok et al.

[11] Patent Number: 4,936,189

[45] Date of Patent: Jun. 26, 1990

[54] TURRET TRAVEL PROTECTION STOP

[75] Inventors: Albert J. Marciniok, Macomb County; Leonard G. McBurney, Oakland County; David Bushell, Macomb County, all of Mich.

[73] Assignee: The United States of America as represented by the Secretary of the Army, Washington, Del.

[21] Appl. No.: 414,172

[22] Filed: Sep. 28, 1989

[51] Int. Cl.[5] ..... F41A 23/24

[52] U.S. Cl. ..... 89/36.14; 89/37.11

[58] Field of Search ..... 89/36.14, 37.11, 37.12

[56] References Cited

U.S. PATENT DOCUMENTS 2,370,148 2/1945 Colby ..... 89/37.12

*Primary Examiner*—Stephen C. Bentley

*Attorney, Agent, or Firm*—Peter A. Taucher; Gail S. Soderling

[57] ABSTRACT

The present disclosure relates to an armored vehicle having a chassis for locomotion and an aromored turret mounted on the chassis. The turret has a lower limit travel stop associated with the shroud surrounding the main gun of the turret to prevent the turret from moving to a position to where the gun tube is endangered of being brought into contact with the ground or various low growing shrubs or trees.

1 Claim, 1 Drawing Sheet

TURRET TRAVEL PROTECTION STOP

GOVERNMENT INTEREST

The invention described herein may be manufactured, used, and licensed by or for the Government for governmental purposes without payment to me of any royalty thereon.

BACKGROUND OF THE INVENTION

1. Field of the invention

In one aspect this invention relates to armored gun turrets. In yet a further aspect this invention relates to control limiting devices useful with armored gun turrets.

2. Prior Art

This invention relates broadly to armored vehicles containing crew members which are adapted to move military personnel under battlefield conditions. The armor on the vehicles is designed to protect the crew from various threats such as projectiles of various shapes and sizes common to battlefield positions. Such armored vehicles generally have a chassis for locomotion containing space and seating arrangements for the crew. The chassis will also contain a source of power, i.e.; diesel engine or gas turbine which furnishes power to propel the vehicle and operate various functions on the vehicle. The chassis may be of the tracked laying variety such as the well known tracked tank or similar fighting vehicles designed to operate under the most severe military environment.

The chassis for fighting vehicles in accordance with this invention has a turret mounted atop the chassis. In general the turret will be mounted so as to rotate about a vertical axis and is arranged to support a large bore cannon. The turret is arranged to swivel through a 360 degree arc to allow the large bore cannon to be pointed at a hostile threat regardless of the position of the tank with respect to the remainder of its battle group. The rotation of the turret is generally controlled by a gunner and effected by means of various hydraulic and mechanical devices well known in the art. A detailed description of turret movement is omitted in the interest of brevity. The main or large board cannon which represents the main source of fire power is rotatability mounted on the turret so the cannon can be elevated through a substantial arc. The cannon can be rotated so as to hit a target from relatively close to the vehicle out to a range of several thousand meters. When the cannon is in the upper position its muzzle is elevated several meters off the ground and therefore protected from contact with a majority of hazards. However, if the cannon is lowered to its lowest point or the elevation mechanism fails and allows the cannon to descend to its lowest possible point, the muzzle of the cannon would be in close proximity to the ground. At the lowest position it would be possible for the cannon muzzle to be jammed into the ground, shrubbery or other low lying obstacles resulting in a blockage of the cannon. If the cannon is discharged when partially or fully blocked, destruction of the cannon is likely. Also, if the cannon muzzle comes into contact with an obstacle the force transmitted to the breech could cause substantial damage to the interior elements of the cannon where it is attached to the turret as well as cause damage to components located near the breech end of the cannon barrel.

SUMMARY OF THE INVENTION

The present invention provides means to prevent the muzzle of the cannon to from coming into contact with the earth or other low lying obstructions due to failure on the part of the elevation system or inattention on the part of the gunner. The invention generally comprises a shroud having an upper surface attached to the upper portion of the turret. The shroud is formed so as to protect the area of the turret where the cannon is attached. The shroud has a lower surface attached to the turret at a location below the level of the cannon. The lower surface of the shroud has a detent extending at an angle from the shroud down toward the chassis. There are complimentary stops attached to the turret. The stop has a first generally horizontally extending surface adapted to engage and prevent further downward motion of the shroud and thereby the turret. There is a second generally vertical surface adapted to engage the detent to prevent further horizontal motion of the detent towards the main body of the chassis. The detent and the stop cooperate to form a cannon travel stop which limits the lowest position of the cannon.

DETAILED DESCRIPTION OF THE INVENTION

Figure 1:
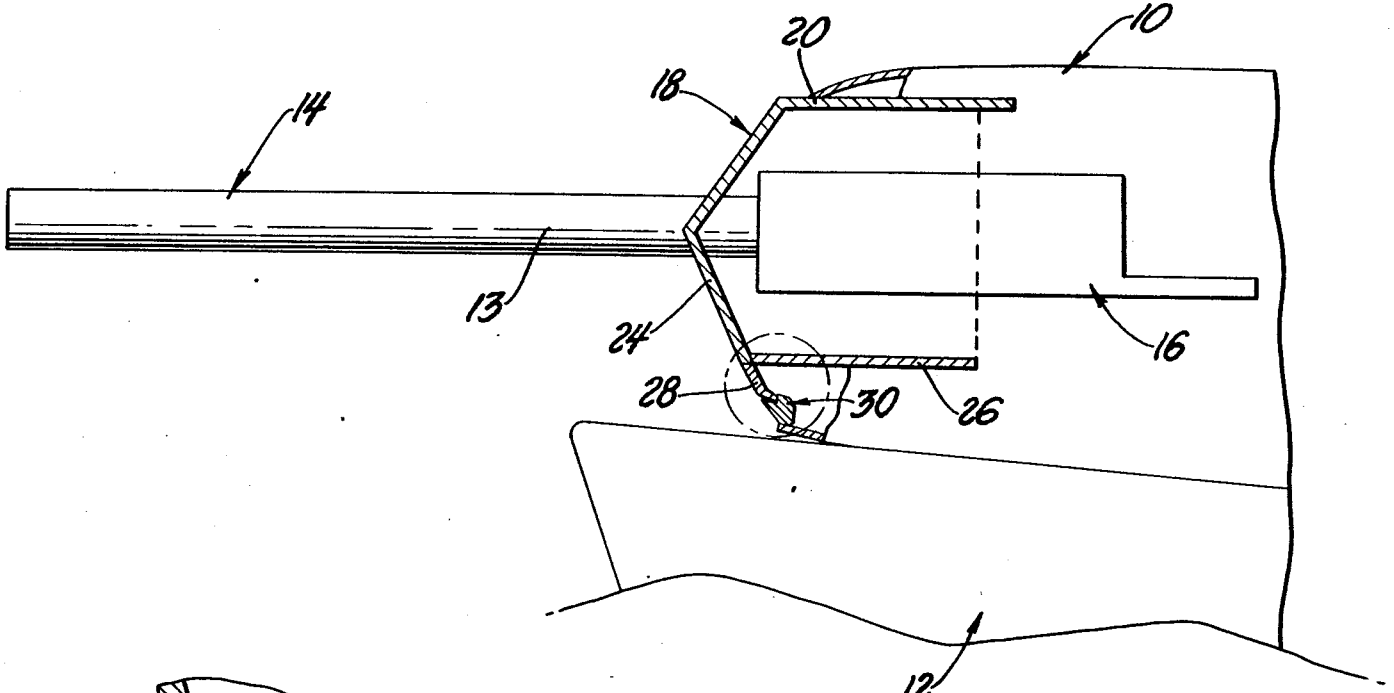
FIG. 1 shows a side view of a portion of a turret with the cannon attached the shroud and the safety device of this invention.

Referring to the accompanying drawing in which like numbers refer to like parts and initially to FIG. 1, a turret 10 which would be mounted atop and attached to chassis 12 is shown schematically. A cannon 14 is mounted to the turret 10 with gun tube 13 extending outward in front of the turret and a breech where ammunition can be loaded for firing is attached to the gun tube and located within the turret. The methods of mounting the turret 10 to the chassis 12 and the mechanisms necessary to operate the turret are well known in the art and the particular structure is not important to this invention. Therefore, a detailed description of the chassis and mounting of the turret to the chassis is omitted in the interest of brevity. A shroud 18 has an upper portion 20 attached to the turret 10 and extending essentially horizontally to a point forward of the turret and as shown makes an angle downward on a second leg 22 to a point approximately midway on the diameter of the gun tube 13. A third leg 24 depends at an angle to the second leg and extends downward and backward, toward the turret, to a fourth leg 26 which extends horizontally back to the turret and is attached to the lower portion of the turret. The second 22 and third 24 legs form an angle in the shroud 18 surrounding the gun tube 13. The angled orientation of the shroud is designed to provide protection since incoming rounds will tend to strike the shroud at an oblique angle increasing the likelihood a projectile will not penetrate the shroud. A detent 28 extends downward from the third leg 24. As shown the detent 28 extends downward below the fourth leg 26 of the shroud 18 and is angled backwards towards the turret 10. The detent 28 as shown has a wide v-shaped cross section. When the gun and associated shroud are pointed downward towards the ground, the pointed end of the detent will move backward in an arcuate path until such time as it contacts a complimentary stop 30 attached to the turret.

Figure 2:
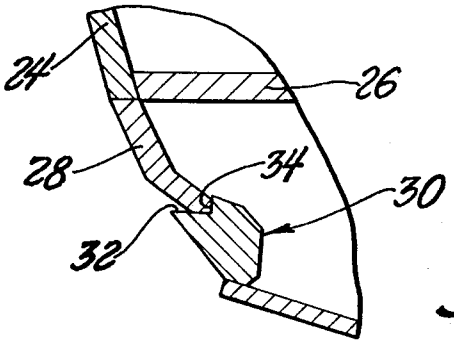
FIG. 2 shows a detail side view in section of a according to this invention.

A more detailed view of the detent 28 and associated complimentary stop 30 are shown in FIG. 2 of the drawing. As the shroud 18 moves downward in an arcuate path it comes into contact with a first generally horizontally extending surface 32 of the complimentary stop 3B and any further motion of the detent serves to push the detent 28 back towards a second complimentary vertical surface 34 of the complimentary stop. In this position, the detent 28 is fully engaged at the point where the horizontal and vertical surfaces meet.

The complimentary stop and associated detent would be custom designed to correspond to the configuration of the vehicle to which it is attached. The complimentary stop will in all cases be positioned so that the detent extending from the lower part of the shroud comes into contact with the stop at a point which would hold the angle of the gun tube well above the normal expected ground level to prevent injury to the expensive and unrepairable cannon. This invention also has the desirable advantage of limiting the rotation of the breach member inside the turret which prevents the breach from being inadvertently forced or positioned to an elevated position where it could come into contact with the components contained in the turret normally located above the breach block.

The shroud would normally be made of a standard armor Plate type material since it is designed to protect the gun and its mounting. The complimentary stop can be fastened to the turret by various means such as welding, riveting or bolting provided it does not destroy the armor's integrity. The complimentary stop would generally be formed of a tough strong armor material such as 4130 steel or the like which would provide a material suitable for absorbing the shock as the gun tube approaches the lower limit of its travel.

I wish it to be understood that I do not desire to be limited to the exact details of construction shown and described for obvious modifications will occur to a person skilled in the art, without departing from the spirit and scope of the appended claims.

We claim:

1. In an armored vehicle having a chassis for locomotion, an armored turret mounted on the chassis, the turret being adapted to rotate about a vertical axis, a large bore cannon mounted in the turret, the cannon being adapted to pivot about a fixed horizontal axis to adjust the cannon elevation, the combination of turret and cannon movement allowing the cannon to be aimed at targets regardless of the orientation of the chassis the improvement comprising: a shroud having an upper surface attached to the turret and being formed so as to surround the cannon and having a lower surface which is attached to the turret at a location below the level of the cannon, the lower surface of the shroud having a detent extending from the shroud, the detent extending at an angle from the shroud towards the chassis, a complimentary stop attached to the chassis the stop having a first generally horizontally extending surface adapted to engage the detent and prevent further downward motion of the shroud and a second generally vertical surface adapted to engage the portion of the detent closest to the turret to prevent further motion of the shroud towards the turret whereby the detent and associated stop cooperate to form travel stop which limits the motion of the cannon to prevent the cannon coming into contact with the ground thereby preventing damage to the cannon.

* * * * *